US008265523B2

(12) United States Patent
Sakuma

(10) Patent No.: US 8,265,523 B2
(45) Date of Patent: Sep. 11, 2012

(54) IMAGE FORMING APPARATUS HAVING REPLACEABLE DEVELOPER CARTRIDGES

(75) Inventor: Susumu Sakuma, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 701 days.

(21) Appl. No.: 12/222,494

(22) Filed: Aug. 11, 2008

(65) Prior Publication Data

US 2009/0041509 A1 Feb. 12, 2009

(30) Foreign Application Priority Data

Aug. 10, 2007 (JP) ..... 2007-210462

(51) Int. Cl.
*G03G 15/04* (2006.01)
*G03G 15/08* (2006.01)

(52) U.S. Cl. ..... 399/119; 399/262

(58) Field of Classification Search ..... 399/110–112, 399/119, 120, 258, 259, 262
See application file for complete search history.

(56) References Cited

U.S. PATENT DOCUMENTS

| | | | | |
|---|---|---|---|---|
| 7,031,637 | B2 * | 4/2006 | Fujita | 399/111 |
| 7,257,349 | B2 | 8/2007 | Kitozaki | |
| 7,657,206 | B2 * | 2/2010 | Sato | 399/119 |
| 2001/0021322 | A1 | 9/2001 | Tsuruya et al. | |
| 2001/0055499 | A1 | 12/2001 | Sato | |
| 2003/0185589 | A1 | 10/2003 | Fujita | |
| 2005/0013633 | A1 | 1/2005 | Harumoto | |
| 2005/0030364 | A1 | 2/2005 | Sato | |
| 2005/0281591 | A1 | 12/2005 | Kitozaki et al. | |
| 2006/0119689 | A1 | 6/2006 | Sato | |
| 2006/0204276 | A1 * | 9/2006 | Takuwa | 399/110 |
| 2006/0285885 | A1 | 12/2006 | Lee | |

FOREIGN PATENT DOCUMENTS

| | | | |
|---|---|---|---|
| JP | 11-073035 | A | 3/1999 |
| JP | 2000-258974 | A | 9/2000 |
| JP | 2001-183886 | | 7/2001 |
| JP | 2001356548 | | 12/2001 |
| JP | 2003-057927 | | 2/2003 |
| JP | 2003084556 | A * | 3/2003 |
| JP | 2003295562 | | 10/2003 |
| JP | 2003295564 | | 10/2003 |
| JP | 2005-037653 | | 2/2005 |
| JP | 2005037675 | | 2/2005 |
| JP | 2006-030957 | A | 2/2006 |
| JP | 2007-004164 | A | 1/2007 |

OTHER PUBLICATIONS

Machine translation of JP 2003084556 A obtained on Apr. 7, 2011.*
Notice of Reasons for Rejection for Japanese Application No. 2007-210462 date mailed Jul. 7, 2009.
Final Decision of Rejection for corresponding Japanese Patent Application 2007-210462 mailed Dec. 22, 2009.

* cited by examiner

*Primary Examiner* — David M Gray
*Assistant Examiner* — Gregory H Curran
(74) *Attorney, Agent, or Firm* — Banner & Witcoff, Ltd.

(57) ABSTRACT

An arrangement for providing developer to process cartridges is described. Developer agent storing members may be insertable into a body containing the process cartridges through a front of the body. The developer agent storing members may be provided on two sides to reduce the stacked height of the developer agent storing members in the body.

31 Claims, 4 Drawing Sheets

IMAGE FORMING APPARATUS HAVING REPLACEABLE DEVELOPER CARTRIDGES

CROSS REFERENCE TO RELATED APPLICATION

This application claims priority from Japanese Patent Application No. 2007-210462, filed on Aug. 10, 2007, the entire subject matter of which is incorporated herein by reference.

TECHNICAL FIELD

Aspects of the invention relate to tandem-type image forming apparatuses.

BACKGROUND

A known tandem-type image forming apparatus includes a plurality of process cartridges spaced in a line, and is configured to print a color image at once.

The image forming apparatus is configured such that toner cartridges can be removed and replaced from the top of the apparatus. Thus, the image forming apparatus requires a space for toner cartridge replacement above, so that its installation site may be limited. When an image reading unit is provided on the top of the image forming apparatus, the toner cartridges cannot be removed from above, and the apparatus should undergo some design changes relating to toner cartridge replacement.

SUMMARY

Aspects of the invention provide an image forming apparatus configured to facilitate toner cartridge replacement without a need to involve design changes in the limitation of the installation site or the availability of an image reading unit.

BRIEF DESCRIPTION OF THE DRAWINGS

Illustrative aspects of the invention will be described in detail with reference to the following figures in which like elements are labeled with like numbers and in which.

DETAILED DESCRIPTION

An illustrative embodiment of the invention will be described in detail with reference to the accompanying drawings. An image forming apparatus according to aspects of the invention applies to a color laser printer 1. It will be appreciated that aspects of the invention apply to other types of image forming apparatuses as well.

It is noted that various connections are set forth between elements in the following description. It is noted that these connections in general and, unless specified otherwise, may be direct or indirect and that this specification is not intended to be limiting in this respect.

For purposes herein, aspects of the invention are shown in relation to an image carrier and developer carrier. In various aspects, the image carrier may include a photosensitive drum, photosensitive belt, or the combination of one of a photosensitive drum or belt and an intermediate transfer drum or belt. Further, the developer carrier may include a developer roller or other systems for conveying developer to the image carrier.

For ease of discussion, in the following description, directions are defined as viewed from a user who operates the color laser printer 1. The top or upper side, the bottom or lower side, the left or left side, the right or right side, the front or front side, and the rear or rear side of the color laser printer 1 are identified as indicated by the arrows in FIG. 2. With regard to various individual objects of the color laser printer 1, sides of the individual objects are similarly identified based on the arranged/attached position of the object on/in the color laser printer 1.

Figure 1:
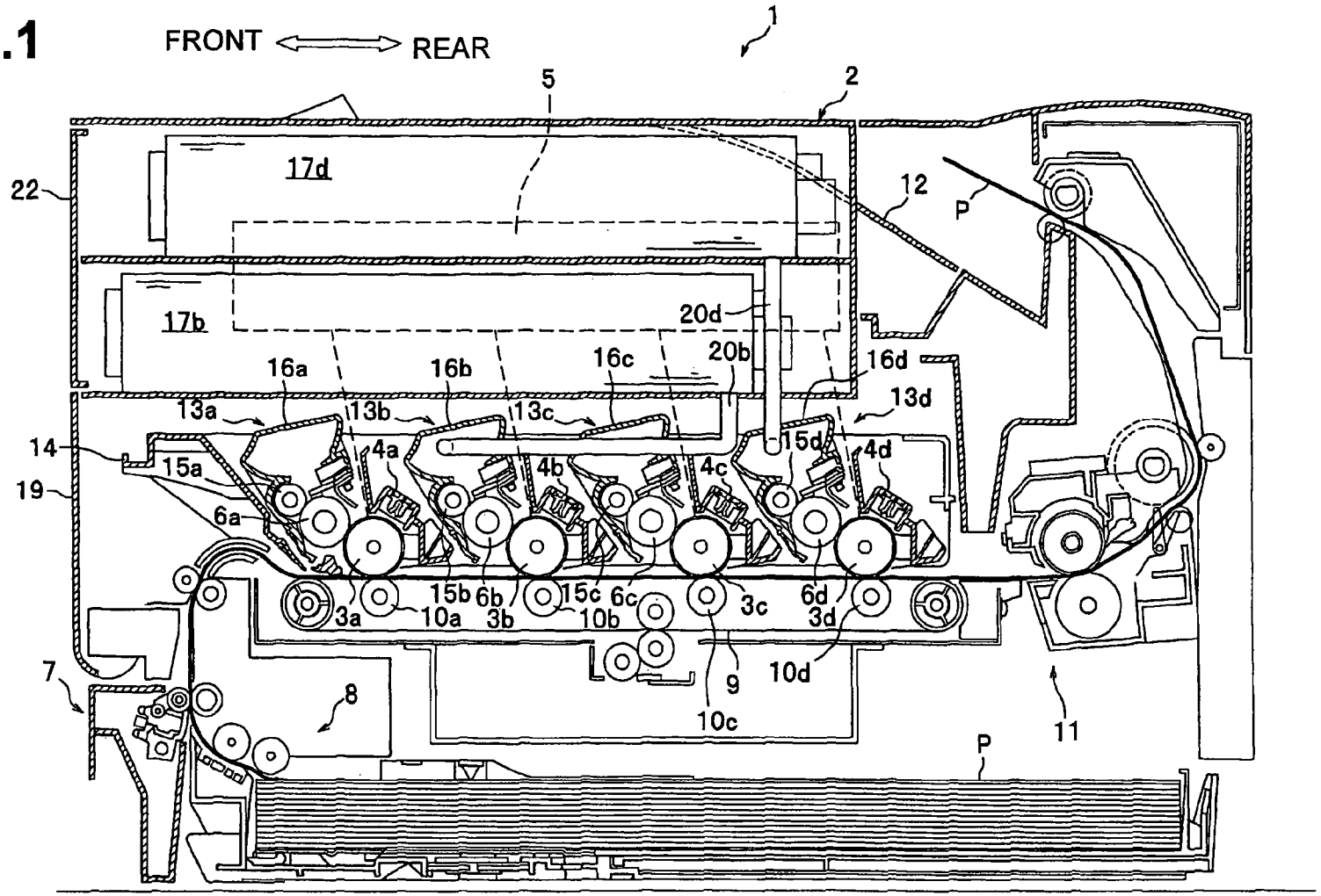
FIG. 1 is a side sectional view of an internal structure of a color laser printer as an illustrative example of an image forming apparatus according to an illustrative embodiment of the invention.

As shown in FIG. 1, the color laser printer 1 may include a plurality of, e.g., four, photosensitive drums 3*a*-3*d* arranged in parallel to each other in a front-rear direction in a body case 2. Surfaces of the photosensitive drums 3*a*-3*d* are regularly charged by corresponding scorotron chargers 4*a*-4*d* and irradiated by laser beams emitted from an exposure unit 5, and electrostatic latent images are formed on the surfaces based on image data. The electrostatic latent images formed on the surfaces of the photosensitive drums 3*a*-3*d* are developed into toner images with corresponding colors of toner (developer) carried on developing rollers 6*a*-6*d*.

A stack of sheets P is stored in a sheet supply cassette 7 disposed in a bottom portion of the body case 2. A topmost sheet P is separated from the stack of sheets P by rollers in a sheet supply portion 8 disposed in a front portion of the body case 2 and conveyed upward to a conveyor belt 9 disposed above and rearward of the sheet supply portion 8. The conveyor belt 9 is disposed facing the photosensitive drums 3*a*-3*d*. Transfer rollers 10*a*-10*d* are disposed within the conveyor belt 9 to face the corresponding photosensitive drums 3*a*-3*d* via the conveyor belt 9. By the action of the transfer rollers 10*a*-10*d* that are biased, toner images in each color on the photosensitive drums 3*a*-3*d* are successively overlapped each other and transferred onto the sheet P conveyed to the conveyor belt 9. The sheet P having four-color toner images thereon is conveyed to a fixing unit 11. The toner images transferred onto the sheet P are thermally fixed by the fixing unit 11, and the sheet P is ejected upward to an output tray 12 by changing the sheet feeding direction from rear to front by rollers.

A plurality of, e.g., four, process cartridges 13*a*-13*d* are disposed between the sheet supply cassette 7 and the exposure unit 5 in the body case 2. The process cartridges 13*a*-13*d* are arranged in tandem in the front-rear direction. The process cartridges 13*a*-13*d* are held in a frame 14 in a detachable manner. The frame 14 is configured to be attached to and removed from the body case 2.

The process cartridges 13*a*-13*d* include the photosensitive drums 3*a*-3*d*, the scorotron chargers 4*a*-4*d*, the developing rollers 6*a*-6*d*, supply rollers 15*a*-15*d*, and toner hoppers 16*a*-16*d*. The process cartridges 13*a*-13*d* are identical in structure except that they have different colors of toner supplied from toner cartridges 17*a*-17*d* to the toner hoppers 16*a*-16*d*. Toner is supplied from the toner cartridges 17*a*-17*d* via the toner hoppers 16*a*-16*d* and the supply rollers 15*a*-15*d* to the developing rollers 6*a*-6*d*.

Figure 2:
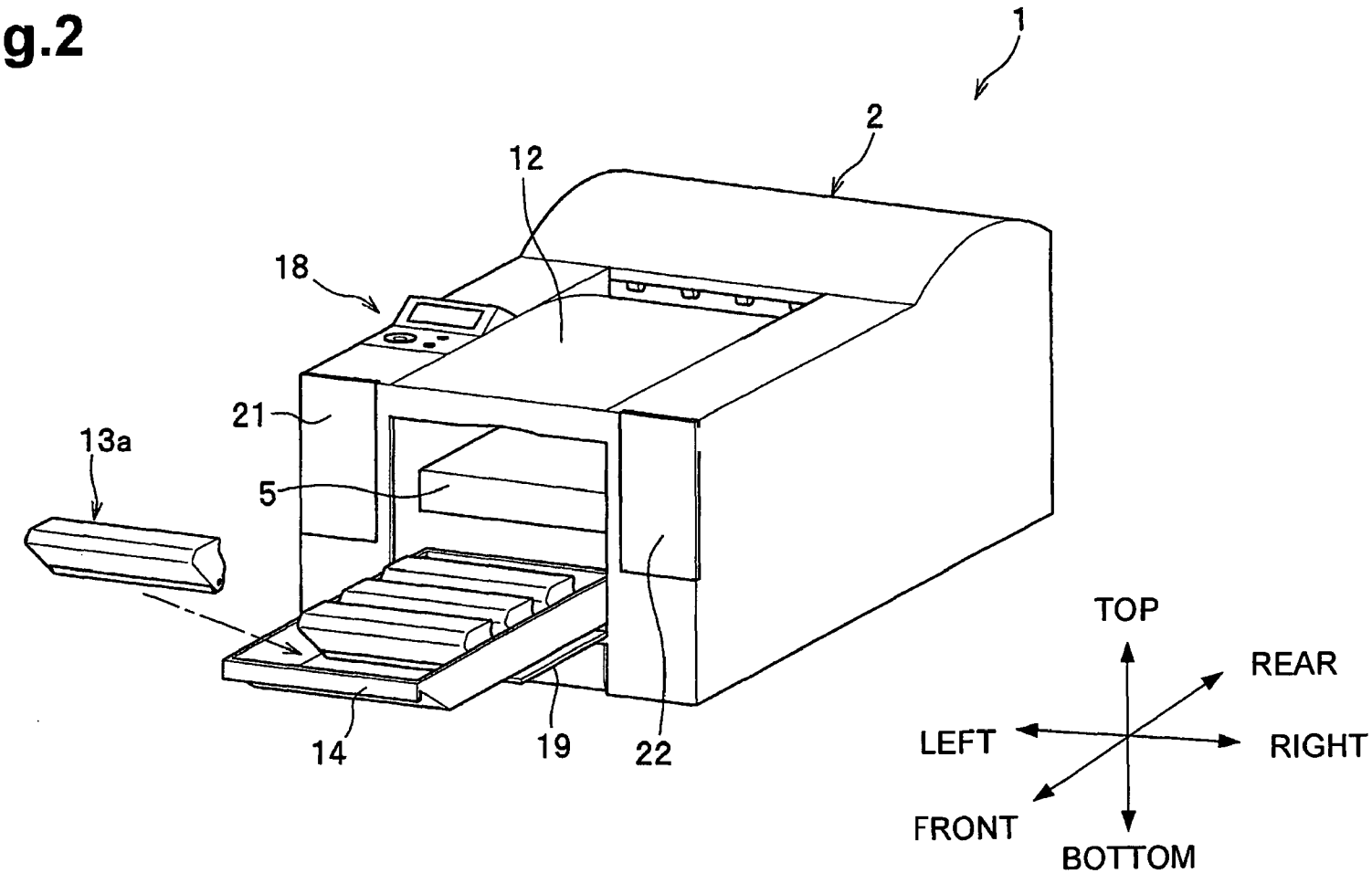
FIG. 2 is a perspective view of an appearance of the color laser printer of FIG. 1 in which a frame accommodating process cartridges is pulled out.

As shown in FIG. 2, an operation unit 18 is disposed at a left front side on an upper surface of the body case 2, so that a user can manipulate the operation unit 18 in front of the color laser printer 1. A front surface of the body case 2 contains a front cover 19. The front cover 19 is pivotally mounted at its lower end to the body case 2. The frame 14 holding the process cartridges 13*a*-13*d* can be pulled toward the front through an opening formed when the front cover 19 is opened. With the frame 14 pulled toward the front, the process cartridges 13*a*-13*d* can be replaced.

Figure 3:
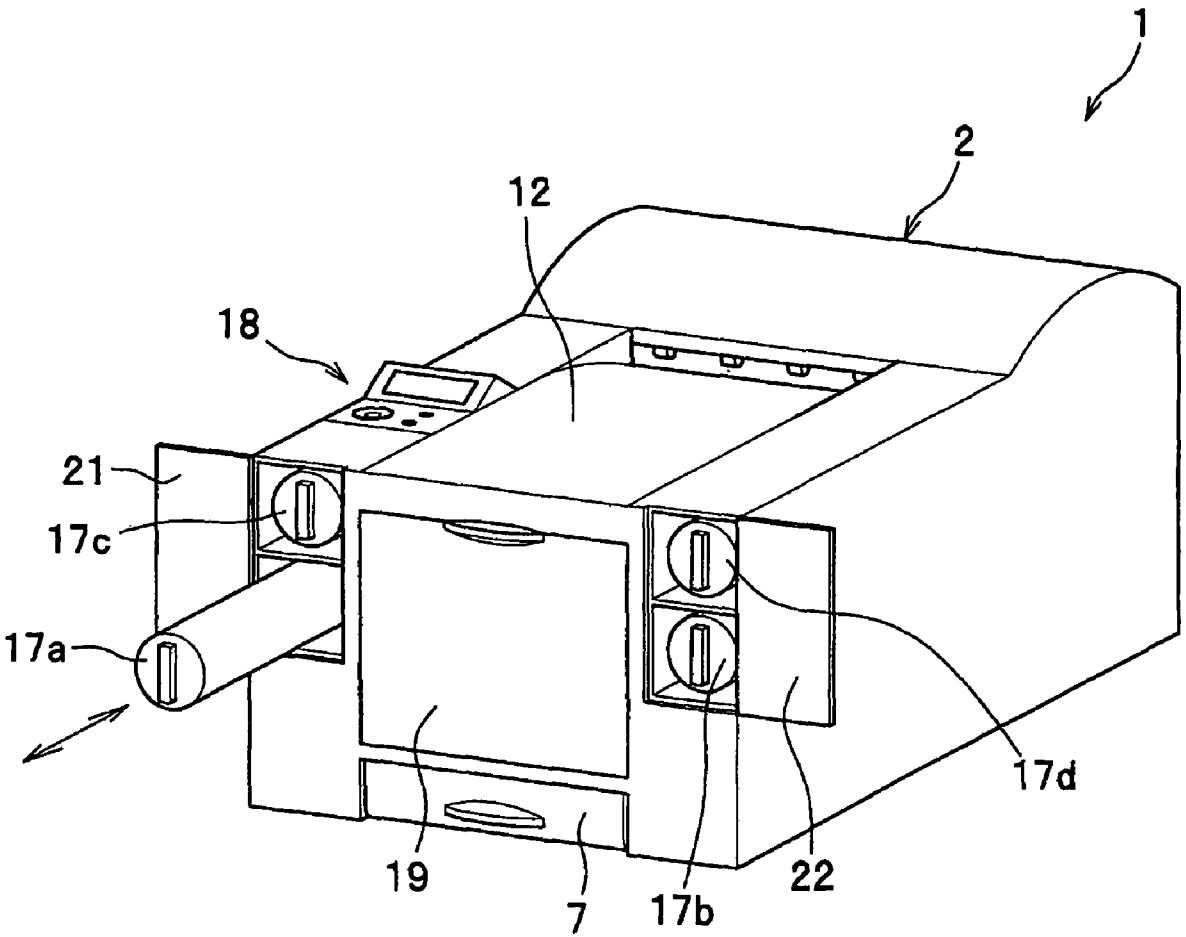
FIG. 3 is a perspective view of the color laser printer where a toner cartridge is replaced.

As shown in FIGS. 1 and 3, the toner cartridges 17*a*-17*d* are disposed two by two on both sides of the exposure unit 5 above the process cartridges 13*a*-13*d* in the body case 2. The toner cartridges 17*a*, 17*c* are vertically arranged on the left side and the toner cartridges 17*b*, 17*d* are vertically arranged on the right side.

The two vertically arranged toner cartridges 17*b*, 17*d* or 17*a*, 17*c* are shifted in a direction where the process cartridges 13*a*-13*d* are arranged in tandem or in the front-rear direction, as shown in FIG. 1. In other words, the rear end of the upper toner cartridge 17*d* or 17*c* is positioned slightly more rearward than the rear end of the lower cartridge 17*b* or 17*a*. Toner supply tubes 20*a*-20*d* (20*a*, 20*c* not shown) are connected on rear sides of the corresponding toner cartridges 17*a*-17*d*. Each toner supply tube 20*a*-20*d* extends vertically downward from the underside of the corresponding toner cartridge 17*a*-17*d*. When the toner cartridge 17*a*-17*d* is removed from the body case 2, it is disconnected from the corresponding toner supply tube 20*a*-20*d*.

The toner cartridges 17*a*-17*d* are cylindrical in shape, and disposed to extend in the direction where the process cartridges 13*a*-13*d* are arranged in tandem, i.e., in the front-rear direction of the body case 2. As shown in FIG. 3, toner cartridge covers 21, 22, are disposed on the front surface of the body case 2. The toner cartridges 17*a*-17*d* are configured to be pulled out from openings formed when the toner cartridge covers 21, 22 are opened. In this manner, the toner cartridges 17*a*-17*d* can be replaced from the front side where the user manipulates the operation unit 18.

Toner contained in each toner cartridge 17*a*-17*d* is supplied via the toner supply tube 20*a*-20*d* to the toner hopper 16*a*-16*d* of the process cartridge 13*a*-13*d* as shown in FIG. 1. The toner cartridges 17*a*-17*d* are identical in structure except that they each contain different colors of toner. Preferably, each toner cartridge 17*a*-17*d* has a known conveying device (not shown), such as an auger, for agitating and conveying toner to the rear of the toner cartridge 17*a*-17*d* (rearward of the body case 2).

Advantages of aspects of the color laser printer 1 described above include the following.

As the toner cartridges 17*a*-17*d* can be pulled toward the front, they can be easily replaced, and the operability of the color laser printer 1 can be improved.

The toner cartridges 17*a*-17*d* are disposed above the process cartridges 13*a*-13*d*. Thus, through the use of gravitation, toner in the toner cartridges 17*a*-17*d* can be supplied via the toner supply tubes 20*a*-20*d* to the toner hoppers 16*a*-16*d* of the process cartridges 13*a*-13*d*. Toner can be more efficiently supplied by provision of a conveying device such as an auger (not shown) inside each toner supply tube 20*a*-20*d*.

The exposure unit 5 can be made in a width the same as or narrower than the image formation area width, but the developing rollers 6*a*-6*d* and the photosensitive drums 3*a*-3*d* should be made wider than the image formation area width. As a result, a space is formed on each side of the exposure unit 5. In this embodiment, four toner cartridges 17*a*-17*d* are disposed two on each side of the exposure unit 5, so that a space inside the body case 2 can be efficiently used.

In the body case 2, a space under which each toner cartridge 17*a*-17*d* is disposed can accommodate a driving unit (now shown) for applying power to rollers including photosensitive drums 3*a*-3*d* and an electrode as a heating device of the fixing unit 11. Thus, the space inside the body case 2 can be efficiently used and the body case 2 can be reduced in size.

As the toner cartridges 17*a*-17*d* are disposed on both sides of the exposure unit 5, there is no need to provide a toner chamber having a certain capacity in each process cartridge 13*a*-13*d*. Thus, the process cartridges 13*a*-13*d* can be reduced in size, especially in height. As the process cartridges 13*a*-13*d* can be reduced in height, the body case 2 also can be reduced in height, and the color laser printer 1 can be provided with a low-profile design.

The toner cartridges 17*a*-17*d* are disposed so that a direction of their length extends in the direction where the process cartridges 13*a*-13*d* are arranged in tandem, i.e., in the front-rear direction of the body case 2. Thus, the size of each toner cartridge 17*a*-17*d* can be secured greatly in its longitudinal direction. In addition, the volume of each toner cartridge 17*a*-17*d* also can be increased.

The two vertically arranged toner cartridges 17*b*, 17*d* (or 17*a*, 17*c*) are disposed out of alignment with each other in the direction where the process cartridges 13*a*-13*d* are arranged in tandem, so that the toner supply tubes 20*a*-20*d* connected on lower parts on the rear of the corresponding toner cartridges 17*a*-17*d* can be extended vertically downward. In other words, as the upper and lower toner cartridges 17*b*, 17*d* (or 17*a*, 17*c*) are disposed out of alignment with each other in the front-rear direction, paths to supply toner from the toner cartridges 17*a*-17*d* to the toner hoppers 16*a*-16*d* (or an arrangement of the toner supply tubes 20*a*-20*d*) can be simplified.

As the frame 14 that holds the process cartridges 13*a*-13*d* detachably is configured to be capable of moving in the same direction as the toner cartridges 17*a*-17*d* are attached to or removed from the body case 2, the toner cartridges 17*a*-17*d* and the process cartridges 13*a*-13*d* can be easily replaced. Thus, the operability of the color laser printer 1 can be improved. In addition, the process cartridges 13*a*-13*d* and the toner cartridges 17*a*-17*d* can be replaced from the front side where the operation unit 18 is manipulated, there is no need to provide a space for replacement above, and thus there is no restraint on the installation site.

In the above embodiment, each process cartridge 13*a*-13*d* integrally includes the photosensitive drum 3*a*-3*d* and the developing roller 6*a*-6*d*. However, the process cartridge 13*a*-13*d* may be a separable combination of a cartridge including the photosensitive drum 3*a*-3*d* and a cartridge including the developing roller 6*a*-6*d*.

In the above embodiment, the four toner cartridges 17*a*-17*d* are disposed two on each side of the exposure unit 17. The number of toner cartridges is not limited to four. Three or more toner cartridges may be disposed on each side of the exposure unit 5. Alternatively, the number of toner cartridge disposed on each side may be different. For example, one toner cartridge may be disposed on one side of the exposure unit 5 and three toner cartridges may be disposed on the other side of the exposure unit 5.

In the above embodiment, the toner cartridges 17*a*-17*d* are identical in size. However, the toner cartridges 17*a*-17*d* may be different in size. For example, a toner cartridge containing black toner, which is relatively quickly used up, may be increased in size.

Figure 4:
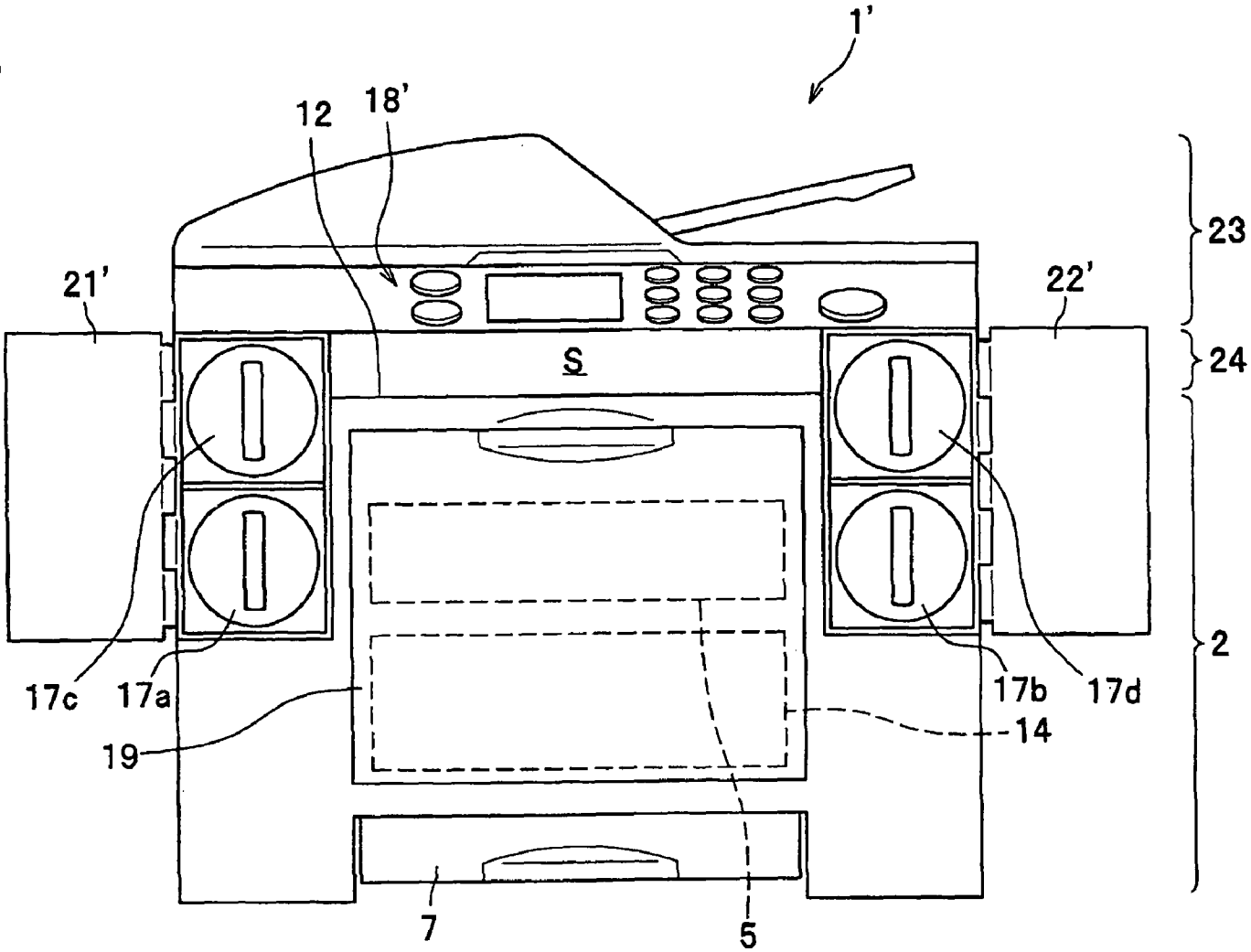
FIG. 4 is a front view of a color multifunction apparatus as another example of the image forming apparatus.

In the above embodiment, the color laser printer 1 is illustrated as an example of the image forming apparatus of the invention. The image forming apparatus according to aspects of the invention applies to a color multifunction apparatus 1' shown in FIG. 4. The color multifunction apparatus 1' may include a flatbed scanner 23 functioning as an image reading unit and a supporting member 24 on top of the body case 2. The flatbed scanner 23 may be disposed on top of the supporting member 24 and include an operation unit 18' for manipulation by a user standing in front of the color multifunction apparatus 1'. The supporting member 24 may be disposed between the flatbed scanner 23 and the body case 2 and configured to support the flatbed scanner 23. In the color multifunction apparatus 1', a sheet P having image thereon may be ejected through a space S enclosed between the body case 2, the flatbed scanner 23 and the supporting member 24, and located on the output tray 12.

In the color multifunction apparatus 1', all or part of the toner cartridges 17*a*-17*d* may be positioned inside the supporting member 24. With this configuration, the inside space of the supporting member 24, which may be substantially hollow in a known color multifunction apparatus, can be efficiently used. In addition, as the process cartridges 13*a*-13*d* and the toner cartridges 17*a*-17*d* can be replaced from the front side of the body case 2 where the operation unit 18' is manipulated, there is no need to make a design change relating to replacement of the toner cartridges 17*a*-17*d* even if the flatbed scanner 23 is provided. Thus, the above described body case 2 can be used for both the color laser printer 1 and the color multifunction apparatus 1', the color laser printer 1 and the color multifunction apparatus 1' can be manufactured in the same manufacturing line, and thus the cost of manufacturing can be reduced.

The above embodiment shows the process cartridges 13*a*-13*d* and the toner cartridges 17*a*-17*d* are configured to be capable of moving together in the same direction as the toner cartridges 17*a*-17*d* are attached or removed. However, the invention is not limited to the embodiment. For example, the process cartridges 13*a*-13*d* may be configured to be capable of moving together in the left-right direction. Alternatively, the process cartridges 13*a*-13*d* may be configured to be capable of being replaced independently.

While the features herein have been described in connection with various example structures and illustrative aspects, it will be understood by those skilled in the art that other variations and modifications of the structures and aspects described above may be made without departing from the scope of the invention. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

a body case;

a plurality of image carriers arranged in a horizontal direction relative to one another in the body case and each configured to carry an electrostatic latent image on a surface of a corresponding one of the image carriers;

an exposure unit configured to expose surfaces of the image carriers and form latent images on the surfaces of the image carriers; and a plurality of developing agent storing members configured to store developing agents therein respectively, the developing agent storing members configured to be attached to and removed from the body case via a side of the body case toward which an operation unit faces and in the horizontal direction in which the image carriers are arranged, wherein at least one of the developing agent storing members is disposed on a first side of the exposure unit and at least another one of the developing agent storing members is disposed on a second side of the exposure unit, wherein the at least one of the developing agent storing members and the at least another one of the developing agent storing members sandwich the exposure unit therebetween in the horizontal direction in which the image carriers are arranged.

2. The image forming apparatus according to claim 1, wherein each of the developing agent storing members extends in the horizontal direction in which the image carriers are arranged.

3. The image forming apparatus according to claim 1, wherein the exposure unit is disposed above the image carriers.

4. The image forming apparatus according to claim 1, wherein the image carriers are located in a first plane and the developer agent storing members are located in a second plane, wherein the second plane is higher than the first plane.

5. The image forming apparatus according to claim 1, further comprising:

an image reading part disposed above the body case; and a supporting member disposed between the body case and the image reading part and being configured to support the image reading part, wherein the developing agent storing members at least partially overlap the supporting member when viewed from an axial direction of the image carriers.

6. The image formatting apparatus according to claim 1, wherein the image carriers are configured to be integrally attached to and removed from the body case in a same direction as a direction in which the developing agent storing members are attached to and removed from the body case.

7. An image forming apparatus comprising:

a body case;

a plurality of image carriers arranged in a horizontal direction relative to one another in the body case in a tandem arrangement, each configured to carry an electrostatic latent image on a surface of a corresponding one of the image carriers;

a plurality of developing agent storing members configured to store developing agents therein respectively, the developing agent storing members configured to be attached to and removed from the body case via a front side of the body case, wherein the front side of the body case extends downward from a top side of the body case; and a plurality of process cartridges, each corresponding to a respective one of the image carriers, wherein at least one of the process cartridges is disposed such that at least one of the developing agent storing members is located on a first side of the at least one of the process cartridges and another one of the developing agent storing members is located on a second side of the at least one of the process cartridges, where the first and second sides are opposite each other.

8. The image forming apparatus according to claim 7, wherein the developing agent storing members are arranged perpendicularly to a shaft supporting each of the image carriers.

9. The image forming apparatus according to claim 7, wherein the plurality of image carriers are configured to be removed from the body case as a group.

10. The image forming apparatus according to claim 7, further comprising:

a scanner, wherein the developing agent storing members are located below the scanner.

11. The image forming apparatus according to claim 7, further comprising:

a scanner, wherein the developing agent storing members are located beside the scanner.

12. The image forming apparatus according to claim 7, wherein the plurality of developing agent storing members are configured to be removed from the body case independently of the removal of the plurality of image carriers from the body case.

13. The image forming apparatus according to claim 7, wherein the body case includes a first door and a second door, and wherein at least one of the developing agent storing members is configured to be attached to and removed from the body case via the first door of the body case, and the plurality of image carriers are configured to be removed from the body case via the second door.

14. An image forming apparatus comprising:

a body case;

a plurality of process cartridges arranged in a direction in the body case, each including a developing roller; and a plurality of developing agent storing members configured to store developing agents therein respectively, and to supply the developing agents to the process cartridges, the developing agent storing members configured to be attached to and removed from the body case via a front side of the body case, wherein at least two of the developing agent storing members are disposed one above the other and horizontally displaced from each other.

15. The image forming apparatus according to claim 14, wherein each of the process cartridges includes an image carrier configured to carry an electrostatic latent image on a surface of the image carrier.

16. The image forming apparatus according to claim 14, wherein the at least two of the developing agent storing members are displaced from each other in the direction in which the process cartridges are arranged.

17. An image forming apparatus comprising:

a body case;

a plurality of process cartridges arranged in a direction in the body case, each including a developing roller; and a plurality of developing agent storing members configured to store developing agents therein respectively, and to supply the developing agents to the process cartridges, the developing agent storing members configured to be attached to and removed from the body case via a front side of the body case, wherein the body case includes a first door and a second door, wherein at least one of the developing agent storing members is configured to be attached to and removed from the body case via the first door of the body case, wherein the plurality of process cartridges are configured to be attached to and removed from the body case via the second door, wherein the first door and the second door are on the front face of the body case, and wherein at least one of the process cartridges is disposed such that at least one of the developing agent storing members is located on a first side of the at least one of the process cartridges and another one of the developing agent storing members is located on a second side of the at least one of the process cartridges, where the first and second sides are opposite each other.

18. The image forming apparatus according to claim 17, wherein each of the process cartridges includes an image carrier configured to carry an electrostatic latent image on a surface of the image carrier.

19. The image forming apparatus according to claim 17, wherein each of the developing agent storing members extends in the direction in which the process cartridges are arranged.

20. The image forming apparatus according to claim 17, wherein the process cartridges are configured to be removed from the body case as a group.

21. The image forming apparatus according to claim 17, further comprising a scanner disposed above the developing agent storing members.

22. An image forming apparatus comprising:

a body case;

first and second image carriers, each configured to carry an electrostatic latent image on a surface of a corresponding one of the first and second image carriers, the first and second image carriers being disposed in the body case and arranged in a direction perpendicular to an axial direction of the first and second image carriers;

an exposure unit configured to expose surfaces of the first and second image carriers and form latent images on the surfaces of the first and second image carriers; and first and second developing agent storing members configured to store developing agents therein respectively, the first and second developing agent storing members being configured to be attached to and removed from the body case via a side toward which an operation unit faces, the first and second developing agent storing members being configured to be attached to and removed from the body case in the direction in which the first and second image carriers are arranged, wherein the first developing agent storing member is disposed on a first side of the exposure unit and at least partially overlaps the exposure unit, when viewed from the axial direction.

23. The image forming apparatus according to claim 22, wherein the second developing agent storing member is disposed on a second side of the exposure unit opposite to the first side, and wherein the first and second developing agent storing members at least partially overlap the exposure unit, when viewed from the axial direction.

24. The image forming apparatus according to claim 23, further comprising a third developing agent storing member disposed under the first developing agent storing member and a fourth developing agent storing member disposed under the second developing agent storing member, wherein the exposure unit at least partially overlaps the third developing agent storing member, when viewed from the axial direction, and wherein the exposure unit at least partially overlaps the fourth developing agent storing member, when viewed from the axial direction.

25. The image forming apparatus according to claim 22, wherein the first and second developing agent storing members extend in the direction in which the first and second image carriers are arranged.

26. The image forming apparatus according to claim 22, wherein the exposure unit is disposed above the first and second image carriers.

27. The image forming apparatus according to claim 22, wherein the first and second image carriers are located in a first plane and the first and second developer agent storing members are located in a second plane, wherein the second plane is higher than the first plane.

28. The image forming apparatus according to claim 22, further comprising:

an image reading part disposed above the body case; and a supporting member disposed between the body case and the image reading part and being configured to support the image reading part, wherein the first and second developing agent storing members overlap the supporting member at least partially, when viewed from the axial direction.

29. An image forming apparatus comprising:

a body case;

first and second image carriers, each configured to carry an electrostatic latent image on a surface of a corresponding one of the first and second image carriers, the first and second image carriers being disposed in the body case and arranged in a direction perpendicular to an axial direction of the first and second image carriers;

an exposure unit configured to expose surfaces of the first and second image carriers and form latent images on the surfaces of the first and second image carriers; and first and second developing agent storing members configured to store developing agents therein respectively, the first and second developing agent storing members being configured to be attached to and removed from the body case via a side toward which an operation unit faces, the first and second developing agent storing members being configured to be attached to and removed from the body case in the direction in which the first and second image carriers are arranged, wherein the first and second developing agent storing members are disposed one above the other on a first side of the exposure unit, and wherein the exposure unit at least partially overlaps the first and second developing agent storing members, when viewed from the axial direction.

30. The image forming apparatus according to claim 29, further comprising a third developing agent storing member disposed on a second side of the exposure unit opposite to the first side, wherein the exposure unit at least partially overlaps the third developing agent storing member, when viewed from the axial direction.

31. The image forming apparatus according to claim 30, further comprising a fourth developing agent storing member disposed under the third developing agent storing member, wherein the exposure unit at least partially overlaps the fourth developing agent storing member, when viewed from the axial direction.

* * * * *